US011162693B2

(12) United States Patent
Tomioka et al.

(10) Patent No.: US 11,162,693 B2
(45) Date of Patent: Nov. 2, 2021

(54) FAN UNIT, AND OUTDOOR UNIT OF AIR CONDITIONER COMPRISING FAN UNIT

(71) Applicant: DAIKIN INDUSTRIES, LTD., Osaka (JP)

(72) Inventors: Hirotaka Tomioka, Osaka (JP); Daiki Hirawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/997,264

(22) Filed: Aug. 19, 2020

(65) Prior Publication Data

US 2020/0378628 A1 Dec. 3, 2020

Related U.S. Application Data

(63) Continuation of application No. PCT/JP2019/002743, filed on Jan. 28, 2019.

(30) Foreign Application Priority Data

Feb. 19, 2018 (JP) ..... JP2018-027078

(51) Int. Cl.
*F24F 7/06* (2006.01)
*F24F 1/38* (2011.01)
(Continued)

(52) U.S. Cl.
CPC ..... *F24F 1/38* (2013.01); *F24F 1/56* (2013.01); *F24F 13/20* (2013.01); *F24F 1/16* (2013.01); *F24F 13/30* (2013.01)

(58) Field of Classification Search
CPC ..... F24F 1/38; F24F 1/56; F24F 1/16; F24F 1/50; F24F 13/20; F24F 13/30
See application file for complete search history.

(56) References Cited

U.S. PATENT DOCUMENTS 10,801,518 B2 * 10/2020 Nakashima ..... F04D 25/0613
2014/0047857 A1 2/2014 Sao et al.
(Continued)

FOREIGN PATENT DOCUMENTS

JP H09-264300 A 10/1997
JP 2010-127595 A 6/2010
(Continued)

OTHER PUBLICATIONS

International Search Report issued in corresponding International Application No. PCT/JP2019/002743 dated Feb. 26, 2019 (3 pages).
(Continued)

*Primary Examiner* — Henry T Crenshaw
*Assistant Examiner* — Kamran Tavakoldavani
(74) *Attorney, Agent, or Firm* — Osha Bergman Watanabe & Burton LLP

(57) ABSTRACT

A fan unit includes: a fan casing having a long side corresponding to either a width or a depth of the fan casing, a short side corresponding to the other of the width or the depth, and an upper surface on which a blow-out grille is mounted; a fan housed in the fan casing and that blows out air from the blow-out grille; and a bell mouth comprising a cylindrical portion surrounding the fan inside the fan casing. The cylindrical portion includes two first arc regions each facing the short side of the fan casing, a second arc region facing the long side of the fan casing, and a guide portion disposed in at least one of the first arc regions. The guide portion includes an extended end portion.

10 Claims, 16 Drawing Sheets

(51) Int. Cl.

| | |
|---|---|
| ***F24F 1/56*** | (2011.01) |
| ***F24F 13/20*** | (2006.01) |
| *F24F 1/16* | (2011.01) |
| *F24F 13/30* | (2006.01) |

(56) References Cited

U.S. PATENT DOCUMENTS

| | | | | |
|---|---|---|---|---|
| 2016/0187005 | A1* | 6/2016 | Kwon | F24F 1/38<br>62/259.1 |
| 2017/0248327 | A1* | 8/2017 | Nezu | F24F 13/20 |
| 2018/0224135 | A1 | 8/2018 | Yamamoto et al. | |
| 2019/0010960 | A1 | 1/2019 | Nakashima et al. | |
| 2019/0107297 | A1 | 4/2019 | Koike et al. | |

FOREIGN PATENT DOCUMENTS

| | | | |
|---|---|---|---|
| JP | 2013-007559 | A | 1/2013 |
| JP | 2017-198388 | A | 11/2017 |
| WO | 2017/068724 | A1 | 4/2017 |
| WO | 2017/077576 | A1 | 5/2017 |
| WO | 2017/145370 | A1 | 8/2017 |

OTHER PUBLICATIONS

Notice of Reasons for Refusal issued in corresponding Japanese Patent Application No. 2018-027078 dated Feb. 19, 2019 (8 pages).
International Preliminary Report on Patentability issued for PCT/JP2019/002743, dated Aug. 27, 2020 (8 pages).
Extended European Search Report issued in corresponding European Patent Application No. 19755165.8 dated Feb. 17, 2021 (8 pages).

* cited by examiner

FAN UNIT, AND OUTDOOR UNIT OF AIR CONDITIONER COMPRISING FAN UNIT

BACKGROUND

Technical Field

The present disclosure relates to a fan unit and an outdoor unit of an air conditioner including the fan unit.

Description of Related Art

In some types of an outdoor unit of an air conditioner, an outdoor heat exchanger is disposed in a lower portion of a casing, and a fan is disposed in an upper portion of the casing (see, for example, Patent Document 1). In this outdoor unit, the fan is housed in the upper portion of the casing having a rectangular shape in a plan view. The fan is surrounded by a cylindrical bell mouth. In this configuration, the cylindrical bell mouth is housed inside the casing having a rectangular shape in a plan view. For this reason, there are narrow spaces and wide spaces between a cylindrical surface of the bell mouth and four side surfaces in front-rear and right-to-left directions of the casing.

PATENT DOCUMENT

Patent Document 1: Japanese Unexamined Patent Publication No. 2013-007559

SUMMARY

In one or more embodiments of the present invention, a fan unit includes:

a fan casing (30) having a long side corresponding to one of a width or a depth and a short side corresponding to the other, the fan casing (30) having an upper surface on which a blow-out grille (32*b*) is mounted;

a fan (7) for blowing out air from the blow-out grille (32*b*), the fan (7) being housed in the fan casing (30); and a bell mouth (9) having a cylindrical portion (55) arranged so as to surround the fan (7) inside the fan casing (30).

The cylindrical portion (55) of the bell mouth (9) of the fan unit has two first arc regions (A1) each facing the short side of the fan casing (30) and a second arc region (A2) facing the long side of the fan casing (30), the cylindrical portion (55) having a guide portion (55*b*) in at least one of the two first arc regions (A1), the guide portion (55*b*) extending further toward a downstream side than a downstream end of the second arc region (A2) in an air-blowing direction.

The guide portion has an extended end formed such that an extending dimension extending from the cylindrical portion continuously increases from each of both end portions of the respective first arc regions of the cylindrical portion to a middle portion of the respective first arc regions.

DETAILED DESCRIPTION

Embodiments of the present invention will be now described.

Figure 1:
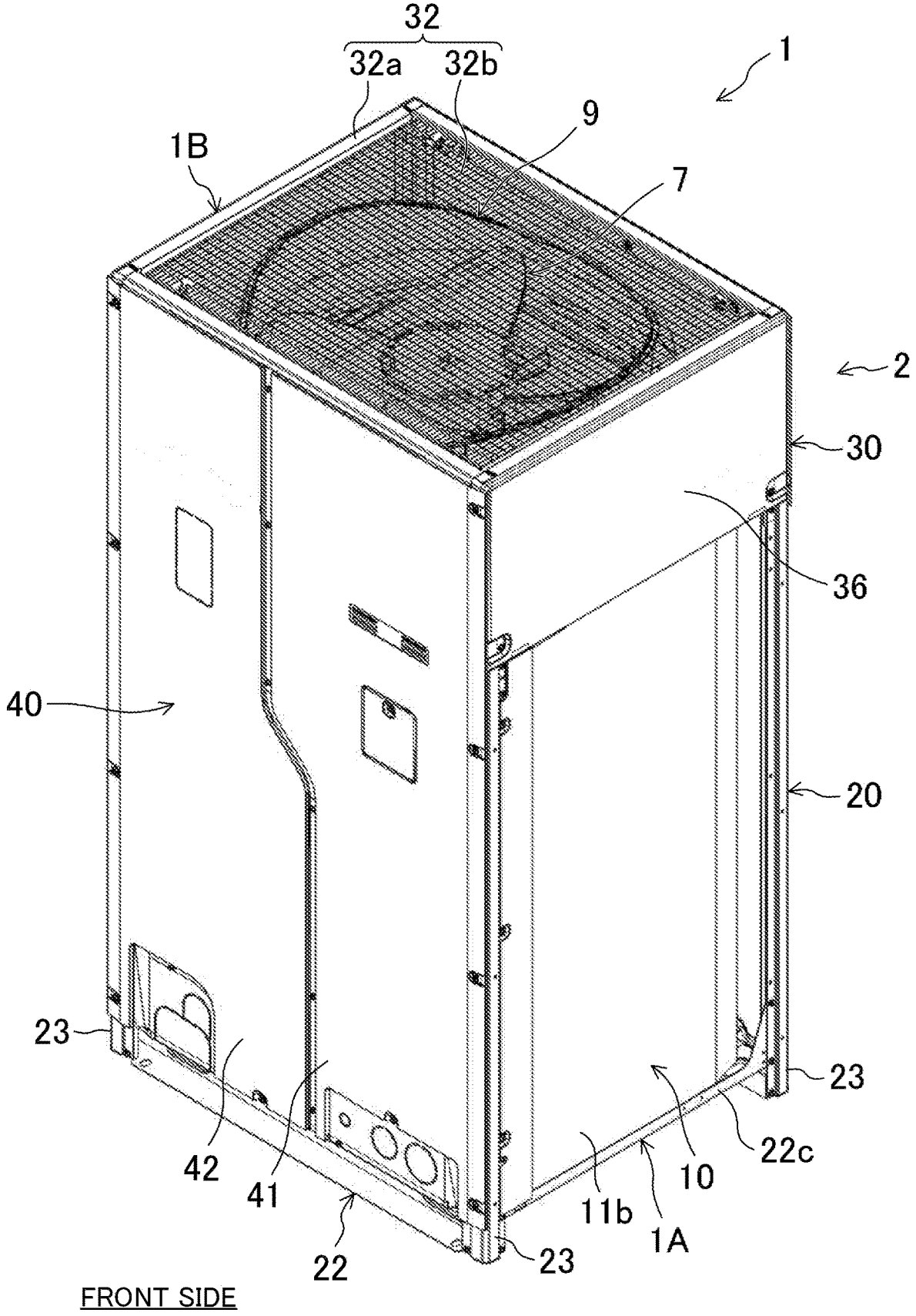
FIG. 1 is a perspective view of an outdoor unit of a first embodiment viewed from a front side.

The embodiment shown in FIG. 1 relate to an outdoor unit (1) of an air conditioner having a lower unit (1A) and an upper unit (fan unit) (1B) attached to the lower unit (1A). The air conditioner is, for example, a multi-type air conditioner in which a plurality of indoor units (not shown) are connected to one outdoor unit (1) via a connection pipe.

The air conditioner provided with the outdoor unit (1) of the present embodiment performs cooling and heating of an indoor space such as an office. A target space in which the air conditioner performs air conditioning is not limited to a living indoor space such as an office or a house. The target space may be a warehouse space for storing articles, a workspace for handling articles (for example, a clean room), or the like.

<Overall Structure of Outdoor Unit>

Figure 2:
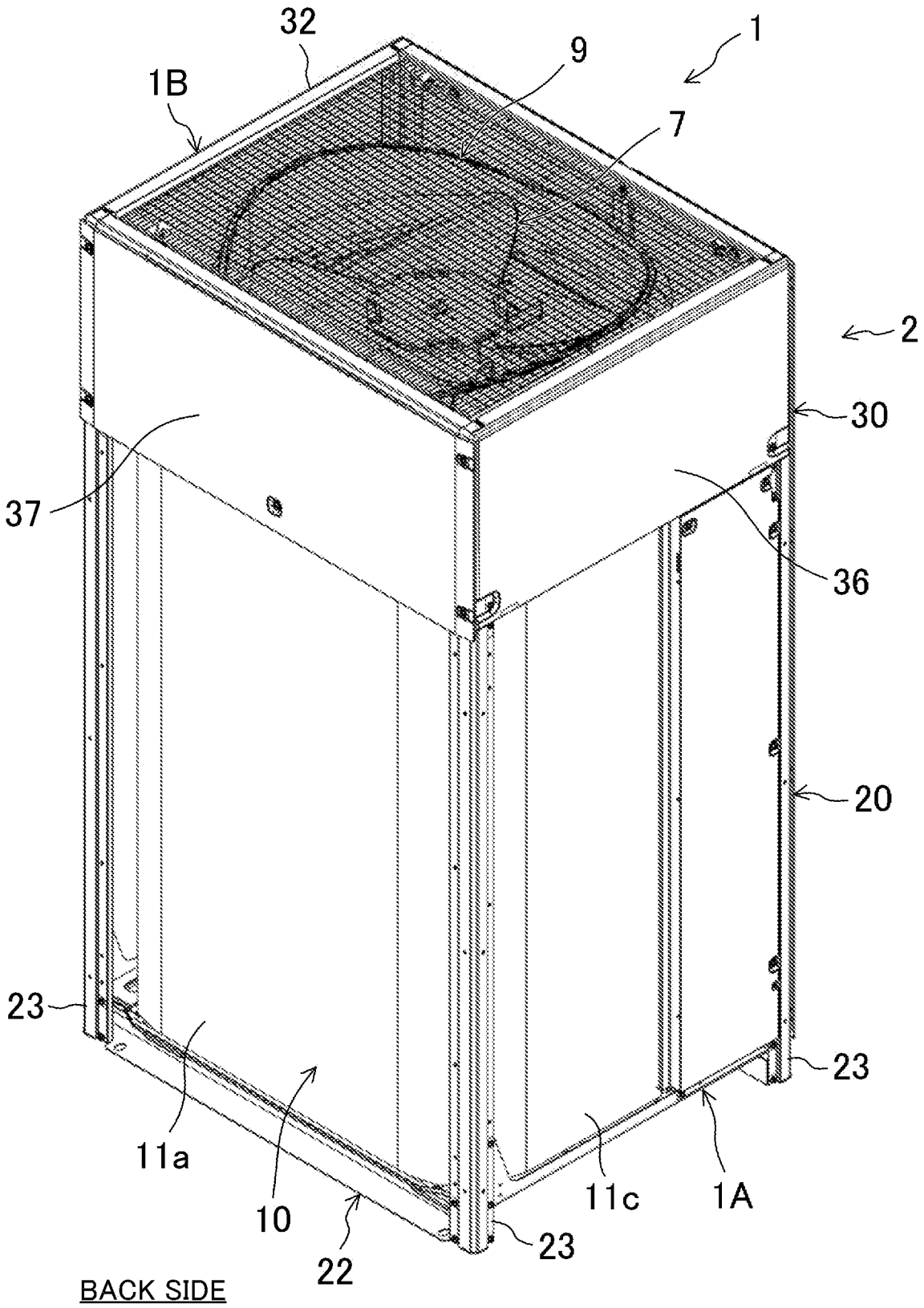
FIG. 2 is a perspective view of the outdoor unit of FIG. 1 viewed from a back side.
Figure 3:
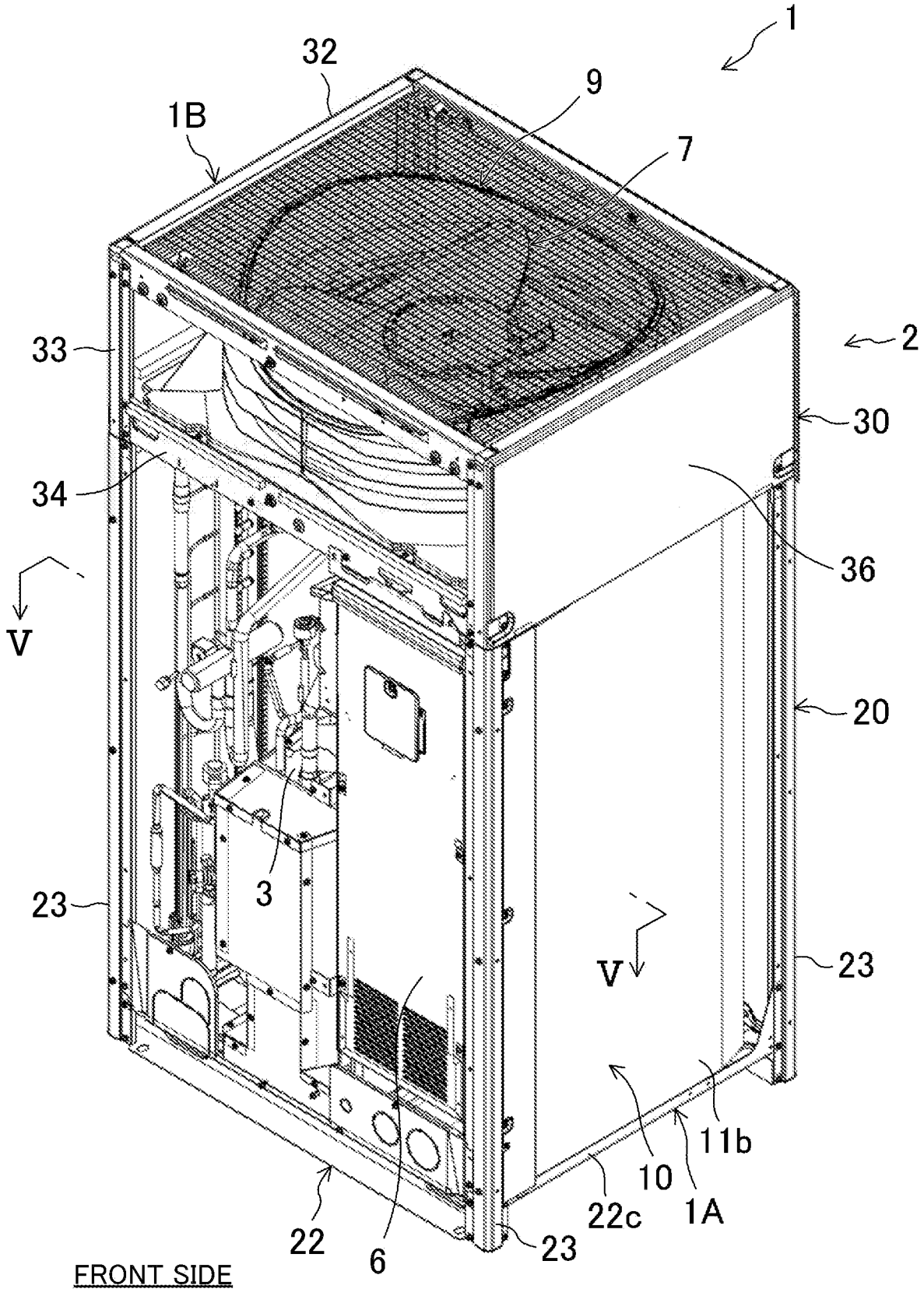
FIG. 3 is a perspective view of the outdoor unit of FIG. 1 without a front panel, viewed from the front side.
Figure 4:
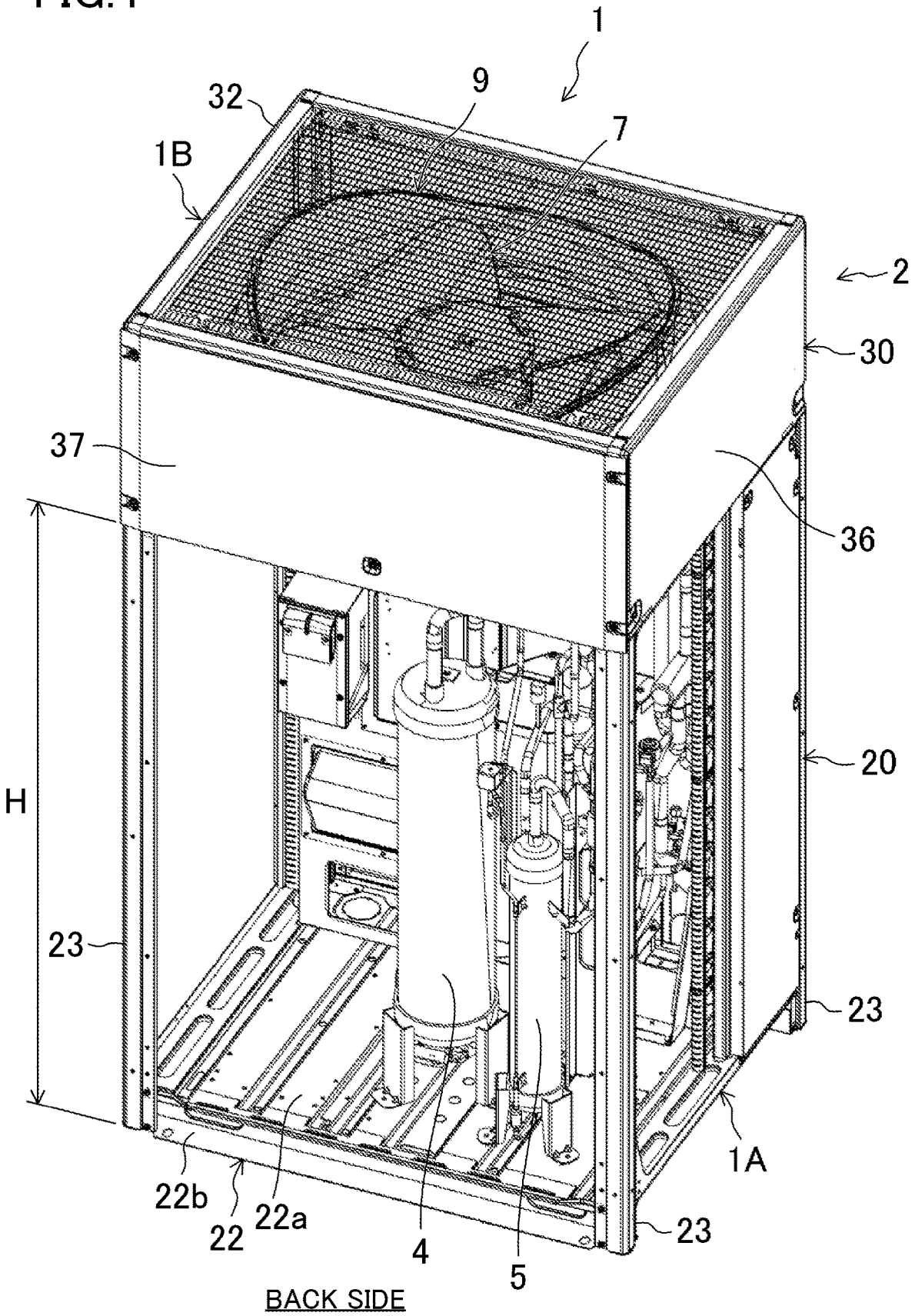
FIG. 4 is a perspective view of the outdoor unit of FIG. 1 without an outdoor heat exchanger, viewed from the back side.
Figure 5:
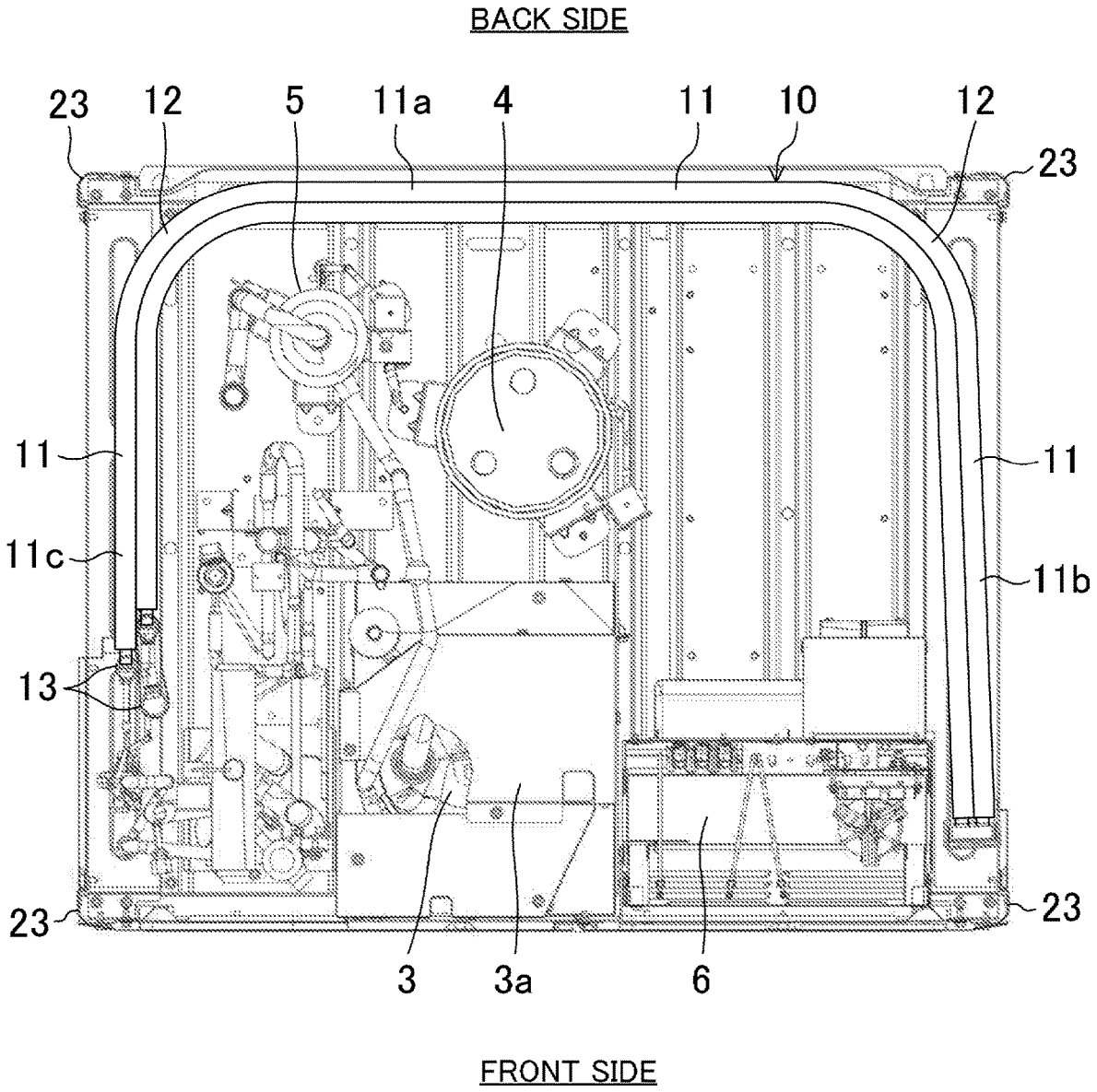
FIG. 5 is a cross-sectional view taken along the line V-V of FIG. 3.

FIG. 1 is a perspective view of the outdoor unit (1) of this embodiment viewed from a front side. FIG. 2 is a perspective view of the outdoor unit (1) of this embodiment, viewed from a back side. FIG. 3 is a perspective view of the outdoor unit of FIG. 1 without a front panel, viewed from the front side. FIG. 4 is a perspective view of the outdoor unit of FIG. 1 without an outdoor heat exchanger, viewed from the back side. FIG. 5 is a cross-sectional view taken along the line V-V of FIG. 3.

The outdoor unit (1) of the air conditioner includes a casing (2) having a vertical rectangular parallelepiped shape. One of a width and a depth (a width in this embodiment) of the casing (2) is a long side of the casing (2) and another (a depth in this embodiment) is a short side of the casing (2). The casing (2) houses components of a refrigerant circuit. The casing (2) includes a lower casing (20), an upper casing (30), and a front panel (40), which are combined to constitute the casing (2).

The upper casing (30) is fixed on the lower casing (20). A width dimension of the lower casing (20) and a width dimension of the upper casing (30) are substantially the same. A depth dimension of the lower casing (20) and a depth dimension of the upper casing (30) are substantially the same, as well. The width dimension is larger than the depth dimension.

The front panel (40) consists of two plate members (front plates) that are vertically elongated and cover substantially an entire area from an upper end of the upper casing (30) to a lower end portion of the lower casing (20). The front panel (40) is mounted across the upper casing (30) and the lower casing (20).

The outdoor unit (1) is provided with components of a refrigerant circuit such as a compressor (3), an outdoor heat exchanger (10), an outdoor expansion valve (not shown), an accumulator (4), and an oil separator (5); and equipment such as a controller (an electric component box (6)) housing electronic components for controlling the refrigerant circuit. Note that the indoor unit (not shown) is provided with components such as an indoor expansion valve and an indoor heat exchanger.

<Lower Unit>

The outdoor heat exchanger (10) is provided in the lower casing (main casing) (20) which serves as a framework of the lower unit (1A). As shown in FIG. 5, the outdoor heat exchanger (10) has a plate-shaped three-surface heat exchanging section (11) and a bent portion (12) between each of the heat exchanging sections (11). The outdoor heat exchanger (10) is formed in a U-shape in a plan view.

In the outdoor heat exchanger (10), the plate-shaped three-surface heat exchanging section (11) has the three surfaces arranged such that its back surface (11*a*) is adjacent to the back surface of the lower casing (20), its right side surface (11*b*) is adjacent to the right side surface of the lower casing (20), and its left side surface (11*c*) is adjacent to the left side surface of the lower casing (20).

Although not shown in detail, this outdoor heat exchanger (10) is a heat exchanger in which ends of a plurality of flat tubes disposed in parallel to each other and extending in a horizontal direction are connected to a header collecting pipe (13). The flat tubes have multiple fins attached at a small pitch. The outdoor heat exchanger (10) is a multi-row heat exchanger in which the flat tubes are arranged in two rows. The outdoor heat exchanger (10) is mounted in the casing (2) such that the header collecting pipe (13) is oriented vertically.

The lower casing (20) is provided also with the compressor (3). The compressor (3) is covered with a cover (3*a*). Equipment such as the accumulator (4), the oil separator (5), and the electric component box (6) is mounted in the lower casing (20), as well. This equipment, the outdoor heat exchanger (10), and the like are incorporated in the lower casing (20), which constitutes the lower unit (1A).

The lower casing (20) constituting the lower unit (1A) has a rectangular base member (22) which is shown in FIG. 4 and four lower supports (23) erected at four corners thereof and extending in the vertical direction. The lower supports (23) are pillars having a height H (FIG. 4) and supporting a lower end surface of the upper casing (30).

The base member (22) has a bottom plate (22*a*) including continuous ridges and grooves in a right-to-left direction of the outdoor unit (1), a long base leg (22*b*) fixed to a front edge and a rear edge of the bottom plate (22*a*), and side stays (22*c*) fixed to left and right side edges of the bottom plate (22*a*). Although not illustrated in detail, the lower supports (23) are fixed to the base leg (22*b*) and the side stays (22*c*) with a plurality of screws.

<Upper Unit (Fan Unit)>

Figure 6:
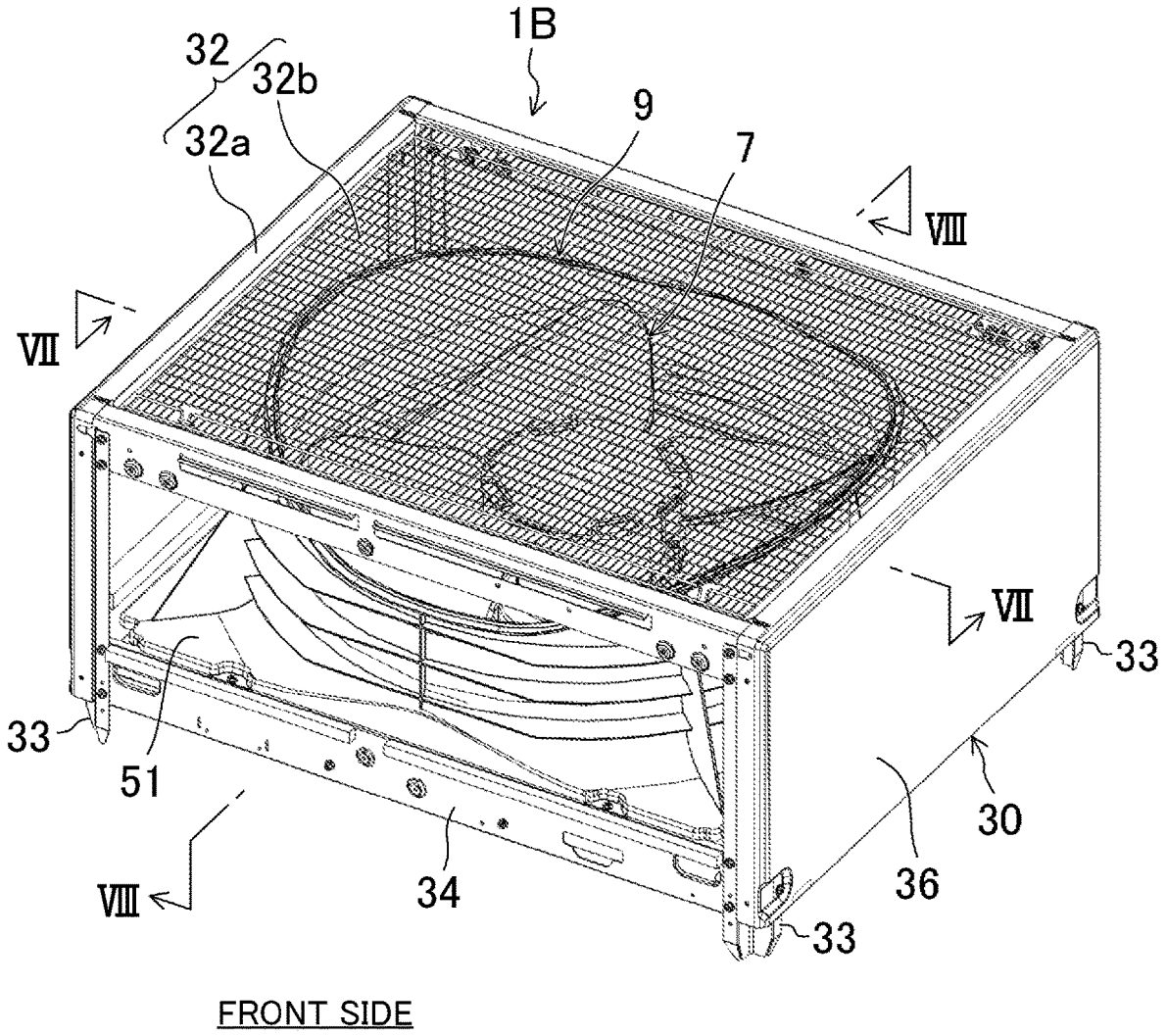
FIG. 6 is a perspective view of the fan unit (an upper unit) viewed from the front side.
Figure 7:
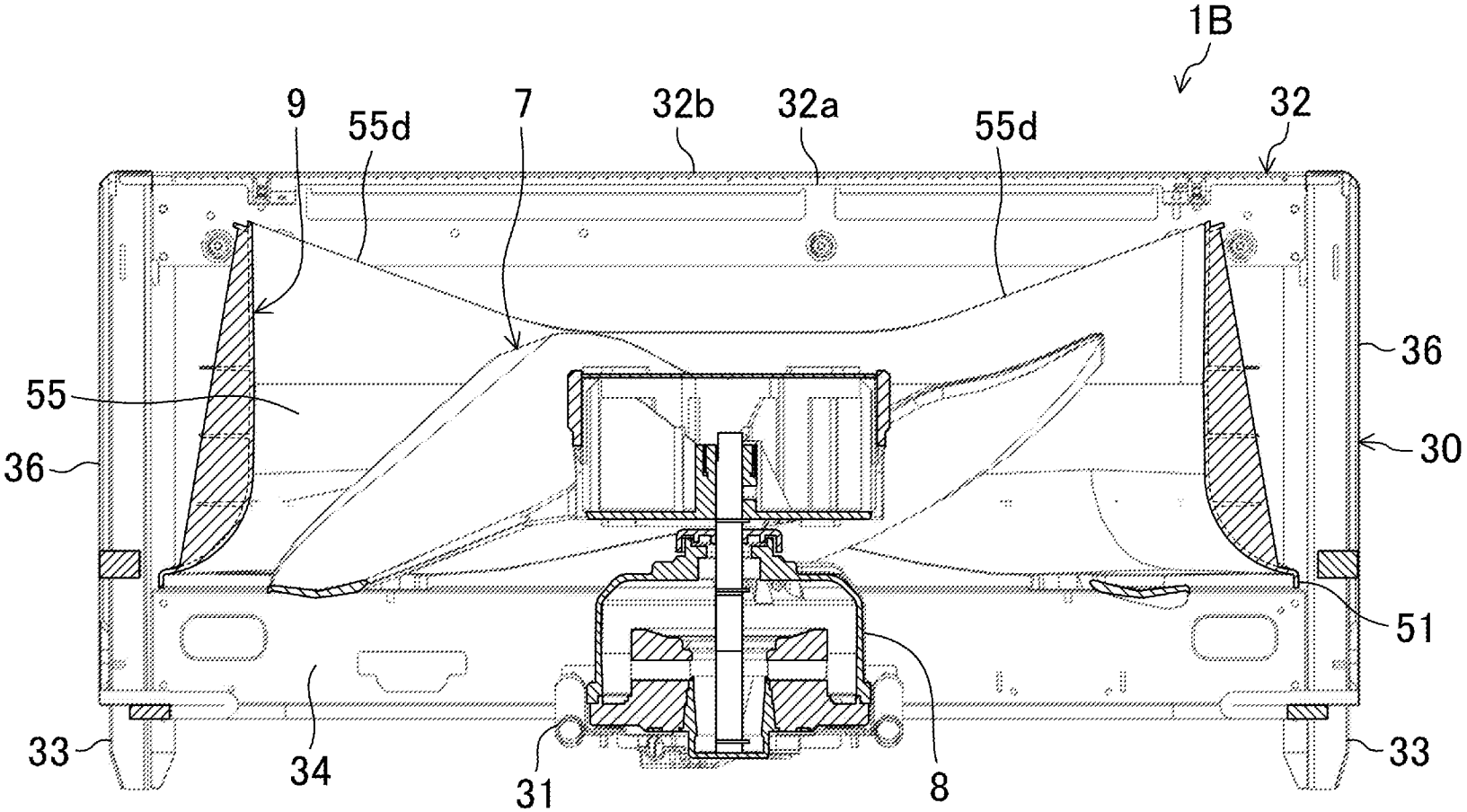
FIG. 7 is a cross-sectional view taken along the line VII-VII of FIG. 6.
Figure 8:
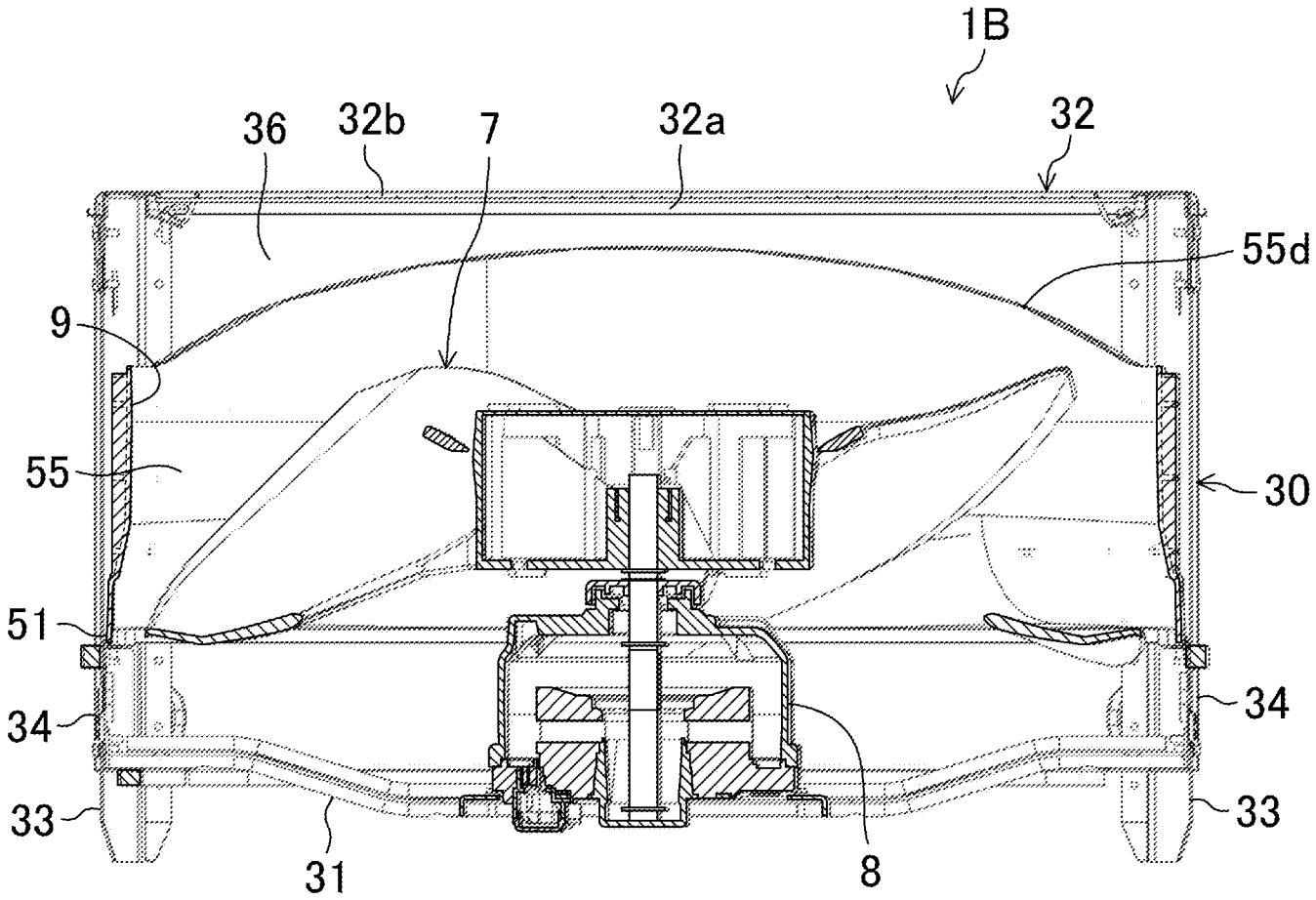
FIG. 8 is a cross-sectional view taken along the line VIII-VIII of FIG. 6.
Figure 9:
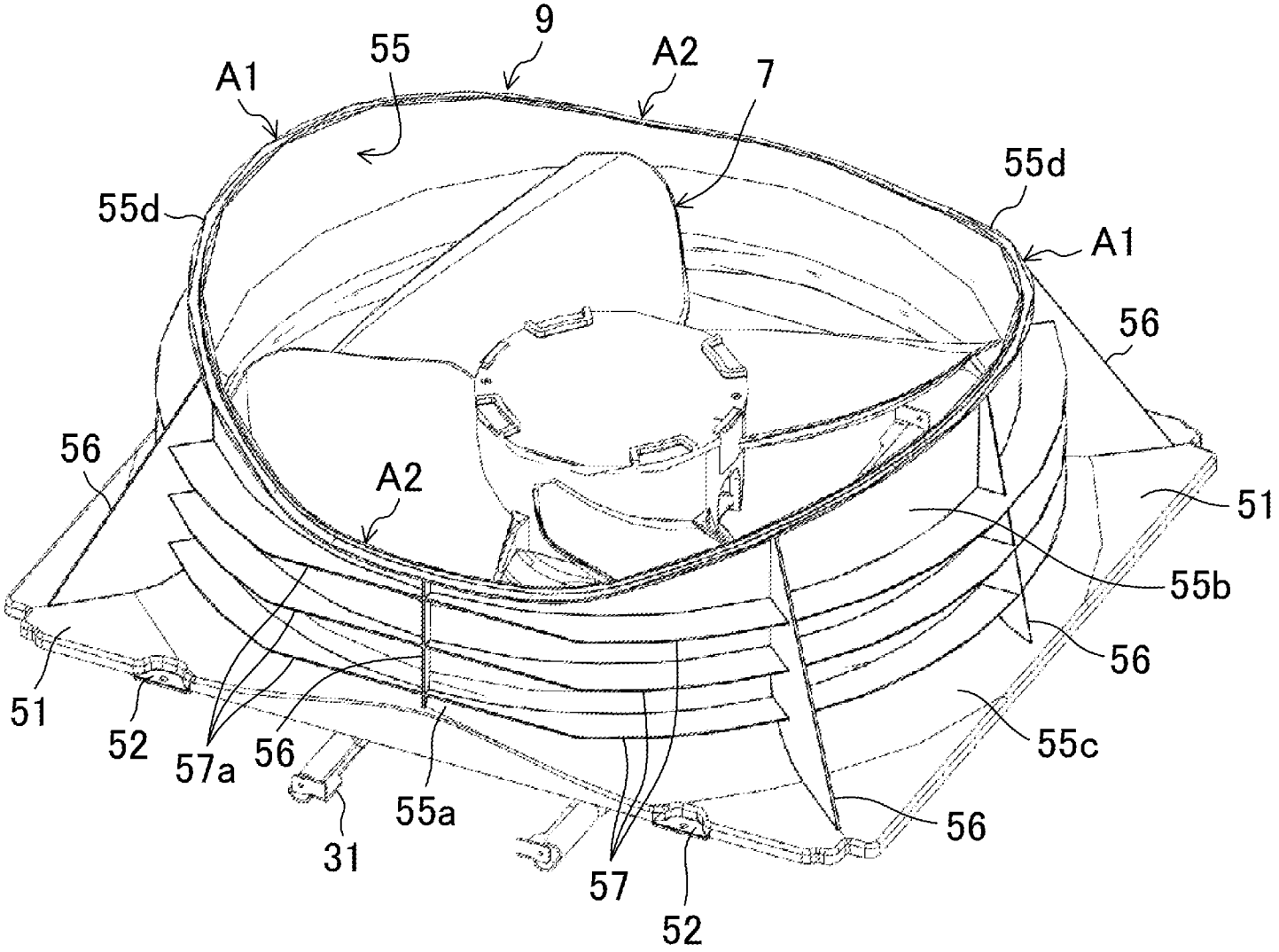
FIG. 9 is a perspective view of a fan and a bell mouth.

FIG. 6 is a perspective view of the upper unit (fan unit) (1B), which is to be mounted on the lower unit (1A), in an independent state, viewed from the front side. FIG. 7 is a cross-sectional view taken along the line VII-VII of FIG. 6. FIG. 8 is a cross-sectional view taken along the line VIII-VIII of FIG. 6. FIG. 9 is a perspective view of a fan and a bell mouth.

The upper casing (fan casing) (30) which is a framework for the upper unit (1B) houses a fan (7). The fan (7) has a rotational center axis extended in the vertical direction such that the fan (7) blows out air upward through a blow-out grille (32*b*) which will be described later. The upper casing (30) is provided with equipment such as a bell mouth (9) disposed so as to surround the fan (7) and a fan motor (8) that is located under the fan (7). When the fan rotates (7), air is sucked from outside of the casing (2) into the lower casing (20) through the outdoor heat exchanger (10), and is then passed through the bell mouth (9) and blown out upward by the fan (7) from the upper casing (30).

The upper casing (30) is provided with a fan motor support base (31) at a lower end portion of the upper casing (30). The fan motor (8) is fixed to the fan motor support base (31), and the fan (7) is mounted on an output shaft of the fan motor (8). The above-mentioned bell mouth (9) surrounds the fan (7), and air flows through the inner side of the bell mouth (9) from the bottom to the top.

The upper casing (30) has a top panel (32) consisting of a frame member (32*a*) and the blow-out grille (32*b*), and four upper supports (33) extending downward from its four corners. Equipment such as the fan (7), the fan motor (8), and the bell mouth (9) is incorporated in a space surrounded by the top panel (32) and the upper supports (33), which constitutes the upper unit (1B). The blow-out grille (32*b*) is mounted on the upper surface of the upper casing (30), and the equipment such as the bell mouth (9) is disposed in the upper casing (30) under the blow-out grille (32*b*).

The front side and the back side of the upper casing (30) are provided with stays (34) which are horizontally elongated reinforcing members coupling the lower end portions of the right and left upper supports (33) with each other. Each of the front side stay (34) and the back side stay (34) has a C-shaped cross section (so-called channel member).

Figure 10:
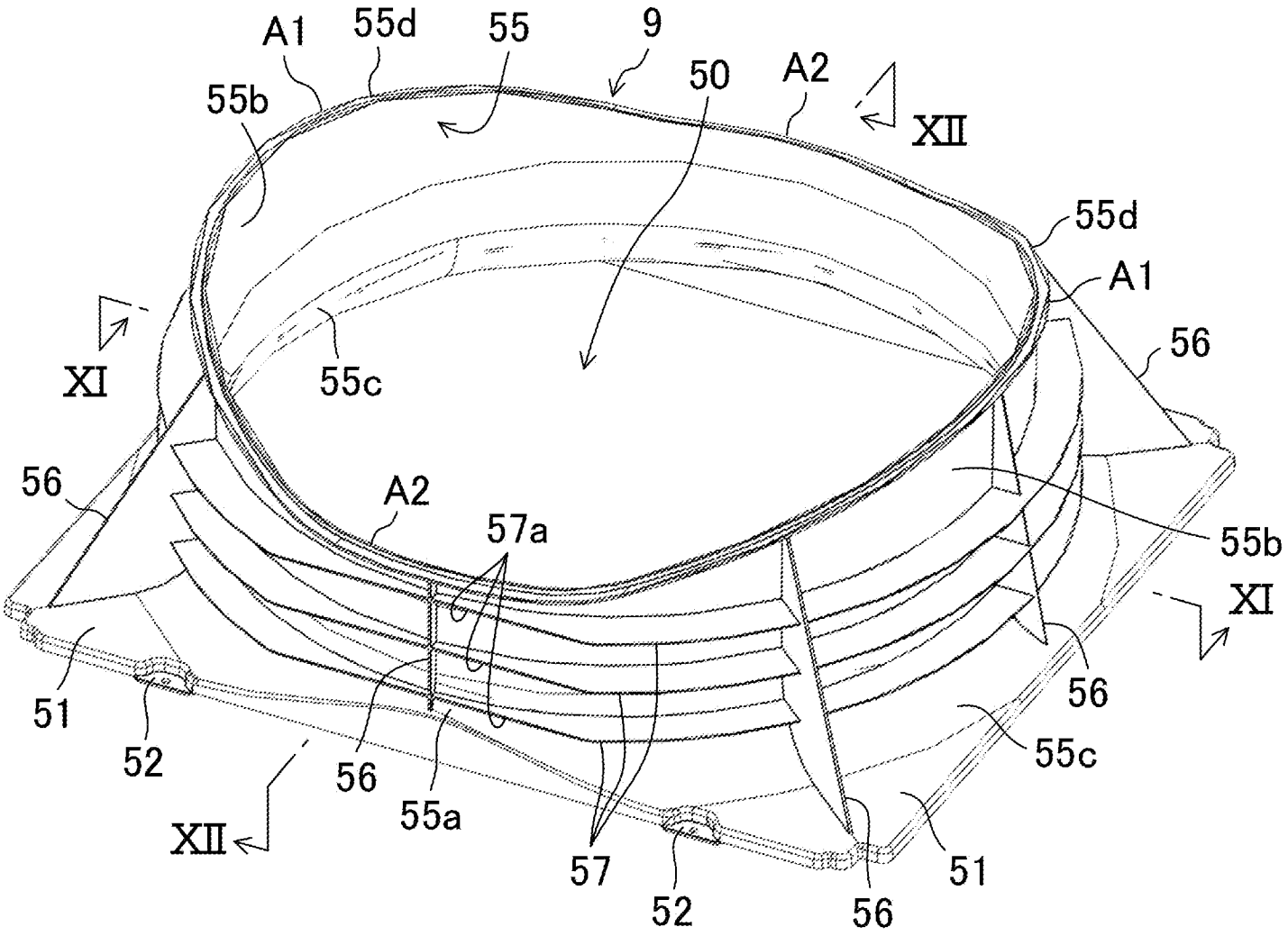
FIG. 10 is a perspective view of the bell mouth.

As shown in FIG. 8, the fan motor support base (31) is fixed to interior surfaces of vertical walls (so-called web portions) of the front side stay (34) and the back side stay (34) As shown in FIG. 9, the bell mouth (9) is a resin molded member made of a flat plate portion (51) and a cylindrical portion (55) formed integrally with the flat plate portion (51). The cylindrical portion (55) erects from the plate portion (51) and surrounds the fan (7) from an outer periphery. The bell mouth (9) has an air-passage hole (50) formed in the center, as shown in FIG. 10. The bell mouth (9) is fastened to an upper horizontal wall (a so-called flange portion) of each channel-shaped stay (34) at positions of mounting seats (52) formed in the plate portion (51) with fastening members such as bolts. The specific structure of the bell mouth (9) will be described later.

The lower end portion of each upper support (33) of the upper casing (30) protrudes downward from the lower surface of the casing (30). Although the structure is not described in detail, the lower end portion of the upper support (33) is configured to be coupled to the upper end portion of a corresponding one of the lower supports (23) of the lower casing (20).

The upper casing (30) has two side panels (36) mounted on the left and right side surfaces and a back panel (37) mounted on the back surface. As described above, an opening in the front surface of the upper casing (30) is closed with the front panel (front plate) (40) mounted across the upper casing (30) and the lower casing (20).

The side panels (36), the back panel (37), and the front panel (40) mounted to the upper casing (30) cover the four surfaces, i.e., front, back, left, and right surfaces of the upper casing (30), except the blow-out grille (32*b*) in the upper surface and the opening on the air-suction side in the lower surface. Air blown out by the fan (7) flows in the space surrounded by these four surfaces.

<Front Panel>

The front panel (40) has a first front plate (41) and a second front plate (42) arranged from the right side to the left side in FIG. 1. The front panel (40) is provided with an opening for piping through which a connection pipe is inserted, an opening for inspection purposes, a cover plate, and the like. As described above, the first front plate (41) and the second front plate (42) of the front panel (40) are vertically elongated plates. Each front plate covers the portion from the lower end of the lower casing (20) to the upper end of the upper casing (30).

<Bell Mouth>

Figure 11:
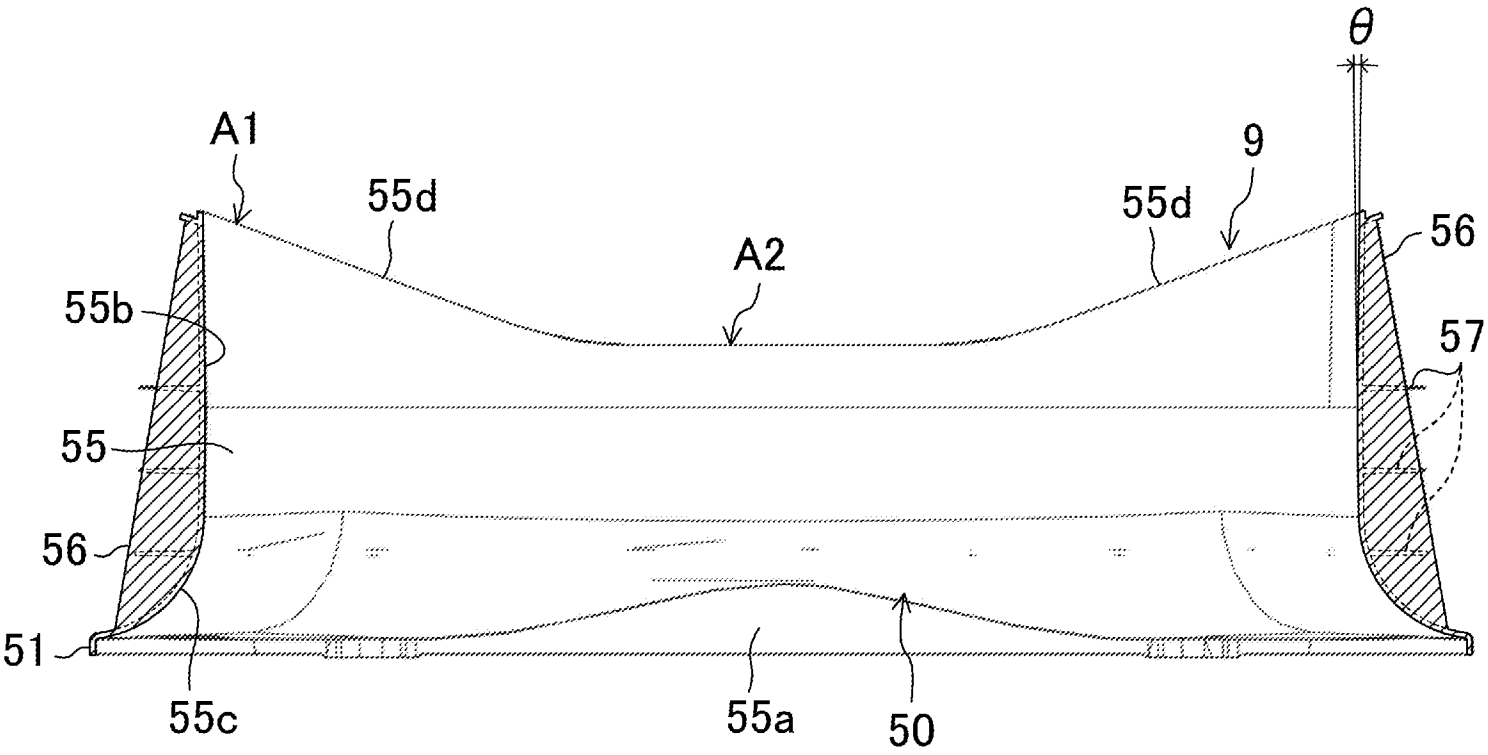
FIG. 11 is a cross-sectional view taken along the line XI-XI of FIG. 10.
Figure 12:
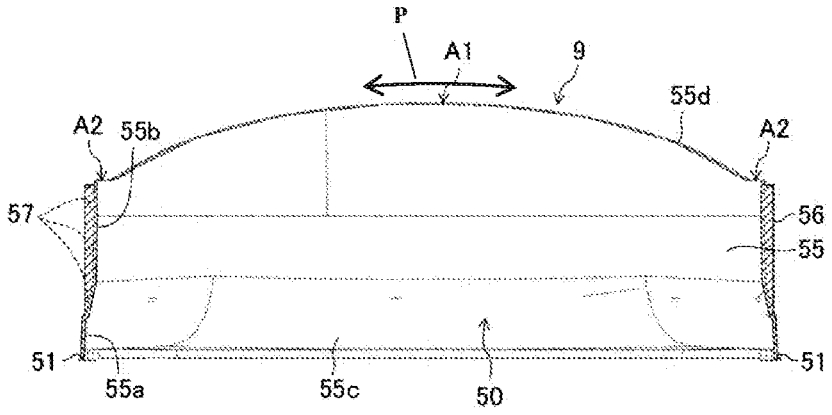
FIG. 12 is a cross-sectional view taken along the line XII-XII of FIG. 10.
Figure 13:
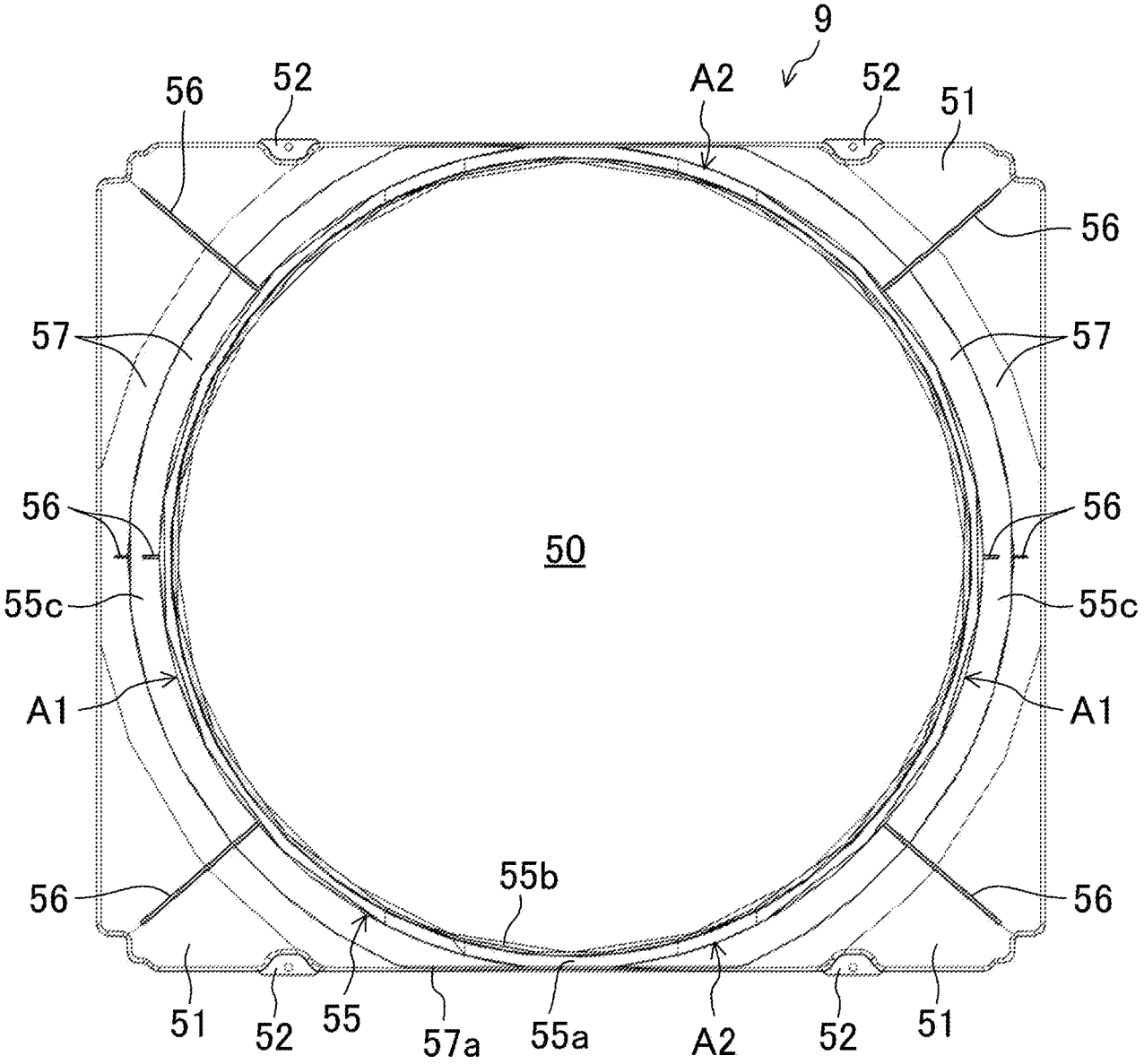
FIG. 13 is a plan view of the bell mouth.

FIG. 10 is a perspective view of the bell mouth (9). FIG. 11 is a cross-sectional view taken along the line XI-XI of FIG. 10. FIG. 12 is a cross-sectional view taken along the line XII-XII of FIG. 10. FIG. 13 is a plan view of the bell mouth (9). For convenience of drawing, a boundary between a flat surface and a curved surface, and boundaries between curved surfaces having different curving shapes are indicated by thin lines in the drawings illustrating the bell mouth (9).

As shown in FIGS. 10 to 13, the plate portion (51) of the bell mouth (9) has a rectangular shape in a plan view. As shown in FIGS. 6 to 8, the width dimension (the dimension in the right-to-left direction in FIG. 13) of the plate portion (51) is slightly smaller than the dimension between the inner sides of the two upper supports (33) located on the left and right sides of the outdoor unit (1). As shown in FIGS. 6 to 8, the depth dimension (the dimension in the vertical direction in FIG. 13) of the plate portion (51) is slightly smaller than the dimension between the outer sides of the two upper supports (33) located on the front and back sides of the outdoor unit (1).

As shown in FIG. 12, the cylindrical portion (55) has a lower cylindrical portion (55*a*) and an upper cylindrical portion (55*b*). The lower cylindrical portion (55*a*) is formed such that its diameter is substantially the same as the depth dimension of the plate portion. The upper cylindrical portion is formed continuously on the lower cylindrical portion (55*a*) and its diameter is slightly smaller than that of the lower cylindrical portion (55*a*). On the other hand, the width dimension of the plate portion (51) is larger than the diameter of the cylindrical portion (55). Therefore, in order to increase an opening area on an inlet side of the air-passage hole (50), the upper cylindrical portion (55*a*) is connected, in a continuous manner, to the plate portion (51) via a curved portion (55*c*) at both left and right sides of the bell mouth (9). The lower cylindrical portion (55*a*) is connected, in a continuous manner, to the curved portion (55*c*) which is formed on both sides in the width direction of the bell mouth (9), while being deformed three-dimensionally.

The cylindrical portion (55) of the bell mouth (9) is provided with a plurality of vertical ribs (56) extending in parallel to the center axis of the cylindrical portion (55), and a plurality of transverse ribs (57) extending in the circumferential direction of the cylindrical portion (55) In FIG. 13, the vertical ribs (56) are formed at eight positions in total: four positions located along center lines passing through the center of the cylindrical portion (55) in the depth and width directions, and four positions located along diagonal segments passing through the center of the cylindrical portion (55) and each of the corners of the plate portion (51). There are three of the transverse ribs (57). The transverse ribs (57) are annular in shape and at right angles with respect to the center axis of the cylindrical portion (55). The transverse ribs (57) are formed at intervals. The transverse ribs (57) are protruding outward in a radial direction from the cylindrical portion (55). Since the diameter of the cylindrical portion (55) is substantially the same as the depth dimension of the plate portion (51), each of the transverse ribs (57) includes straight portions (57*a*) at two positions in the depth direction of the transverse rib (57) to avoid interference with the front panel (40) and the back panel (37). In a plane view of the bell mouth (9), the straight portions (57*a*) are located on the inner side in the depth dimension of the plate portion (51).

As shown in FIGS. 9 to 13, the cylindrical portion (55) of the bell mouth (9) has two first arc regions (A1) each facing the short side of the upper casing (30) (in other words, regions positioned on the both ends along the width dimension of the casing (30)), and second arc regions (A2) each facing the long side of the upper casing (30) (in other words, regions positioned on the both ends along the depth dimension of the casing (30)). The cylindrical portion (55) has guide portions (55*b*) in the two first arc regions (A1), and each guide portion (55*b*) extends further toward a downstream side than the downstream end of the second arc regions (A2) in the air-blowing direction. The guide portions (55*b*) are formed such that the cylindrical portion (55) partially extends toward the downstream side in an airflow direction.

The guide portions (55*b*) are formed at two positions in the cylindrical portion (55). The two guide portions (55*b*) are respectively formed in the two first arc regions (A1) of the cylindrical portion (55) and face each other.

As shown in FIGS. 9 to 11, each guide portion (55*b*) has a greater dimension extending from the cylindrical portion (55), from each of end portions of the first arc region (A1) of the cylindrical portion (55) toward a middle portion (P) thereof. In this embodiment, the extending dimension is determined so that the end portion (extended end) (55*d*) toward the downstream side of the guide portion (55*b*) in the airflow direction has a smoothly curved inclination. Thus, the extending amount of the guide portion (55*b*) continuously increases from the both end portions of the first arc region (A1) toward the middle portion (P) thereof.

As shown in FIG. 11, the guide portion (55*b*) is configured such that the interior surface of the cylindrical portion (55) gradually inclines radially outward from the upstream side to the downstream side in the air-blowing direction. The inclination angle is represented by θ in the drawing. Due to this inclination, the guide portion (55*b*) functions as a diffuser that facilitates the flow of air by lowering wind velocity. Further, if the bell mouth (9) is manufactured by resin molding, the inclination can be formed by utilizing, for example, a draft angle.

—Airflow in Bell Mouth—

In the first embodiment, the end in the air-blowing direction of the first arc region (A1) in which the guide portion (55*b*) is formed is positioned further toward a downstream side than the end in the air-blowing direction of the second arc region (A2). Thus, the air easily flows from the downstream end of the second arc region (A2) toward the first arc region (A1) and toward the downstream side of the bell mouth (9). In particular, since the extended end of the first arc region (A1) is inclined such that the dimension increases from each of the end portions of the region toward the middle portion (P) thereof, the air easily flows along the inclination of the guide portion (55*b*).

Therefore, since air easily flows through the first arc region (A1), the air is pushed out and smoothly flows through the end portion on the downstream side of the first arc region (A1), as well. As a result, the air is easily blown out from the blow-out grille (32*b*) since it is less likely to linger in the space outside the bell mouth (9) and in the wide spaces on both sides in the width direction of the fan casing (30).

—Advantages of Embodiments—

According to the first embodiment, a fan unit (1B) includes: an upper casing (fan casing) (30) having a long side corresponding to one of a width or a depth and a short side corresponding to the other, the fan casing (30) having an upper surface on which a blow-out grille (32*b*) is mounted; a fan (7) for blowing out air from the blow-out grille (32*b*), the fan (7) being housed in the upper casing (30); and a bell mouth (9) having a cylindrical portion (55) arranged so as to surround the fan (7) inside the upper casing (30), wherein the cylindrical portion (55) of the bell mouth (9) includes, in two first arc regions (A1), guide portions (55*b*) each extending further toward a downstream side than a downstream end of a second arc region (A2) in an air-blowing direction.

In a conventional configuration, air has been lingering in both the first arc region (A1) and the second arc region (A2). In contrast, according to the first embodiment, air flows along the guide portions (55*b*) toward the downstream side of the bell mouth (9). Therefore, as described above, if a clearance between the bell mouth (9) and the upper casing (30) is wide, the air is less likely to linger in the spaces at both end portions in the width direction of the upper casing (30), and the air is easily blown out from the blow-out grille (32*b*). As a result, the loss in the blow-out air volume may be reduced.

In the first embodiment, the guide portions (55*b*) are respectively formed in two positions of the cylindrical portion (55), that is, the two first arc regions (A1) of the cylindrical portion (55), so as to face each other. This configuration of the respective guide portions (55*b*) reduces the air lingering in the two spaces at both end portions in the width direction of the upper casing (30). Therefore, the loss of the blow-out air volume may be reduced efficiently in comparison to the loss of the blow-out air volume in a case in which, for example, only one guide portion (55*b*) is provided.

In the first embodiment, the two guide portions (55*b*) is inclined such that the extending dimension of the guide portion (55*b*) increases from each of both end portions of the first arc region (A1) toward the middle portion (P) thereof. Such a configuration allows air to flow easily from the both end portions of the first arc region (A1) toward the middle portion (P) thereof along the inclination of the downstream end of the first arc region (A1) in the air-blowing direction. Thus, a vortex is less likely to occur at the first arc region (A1). Consequently, the inclination in the guide portions (55*b*) allows the air to flow easily in the wide spaces in the both sides of the upper casing (30) in the width direction, and the air is less likely to linger in those spaces. Therefore, the loss of the blow-out air volume may be further effectively reduced.

In the present embodiment, the interior surface of each of the guide portions (55*b*) gradually inclines radially outward from the upstream side to the downstream side in the air-blowing direction. This configuration allows the guide portions (55*b*) to function as a diffuser. Thus, the air in the bell mouth (9) flows easily along the interior surface of the first arc region (A1) where the guide portions (55*b*) are provided. As described above, in the first arc region (A1), the air is less likely to linger in an air-blowing portion, and hence the blow-out air volume blown out from the blow-out grille (32*b*) is larger than the blow-out air volume in a case without a diffuser. Therefore, the loss of the blow-out air volume can be reduced by this configuration, as well.

<<Other Embodiments>>

The foregoing embodiment may be modified as follows.

—First Modification—

Figure 14:
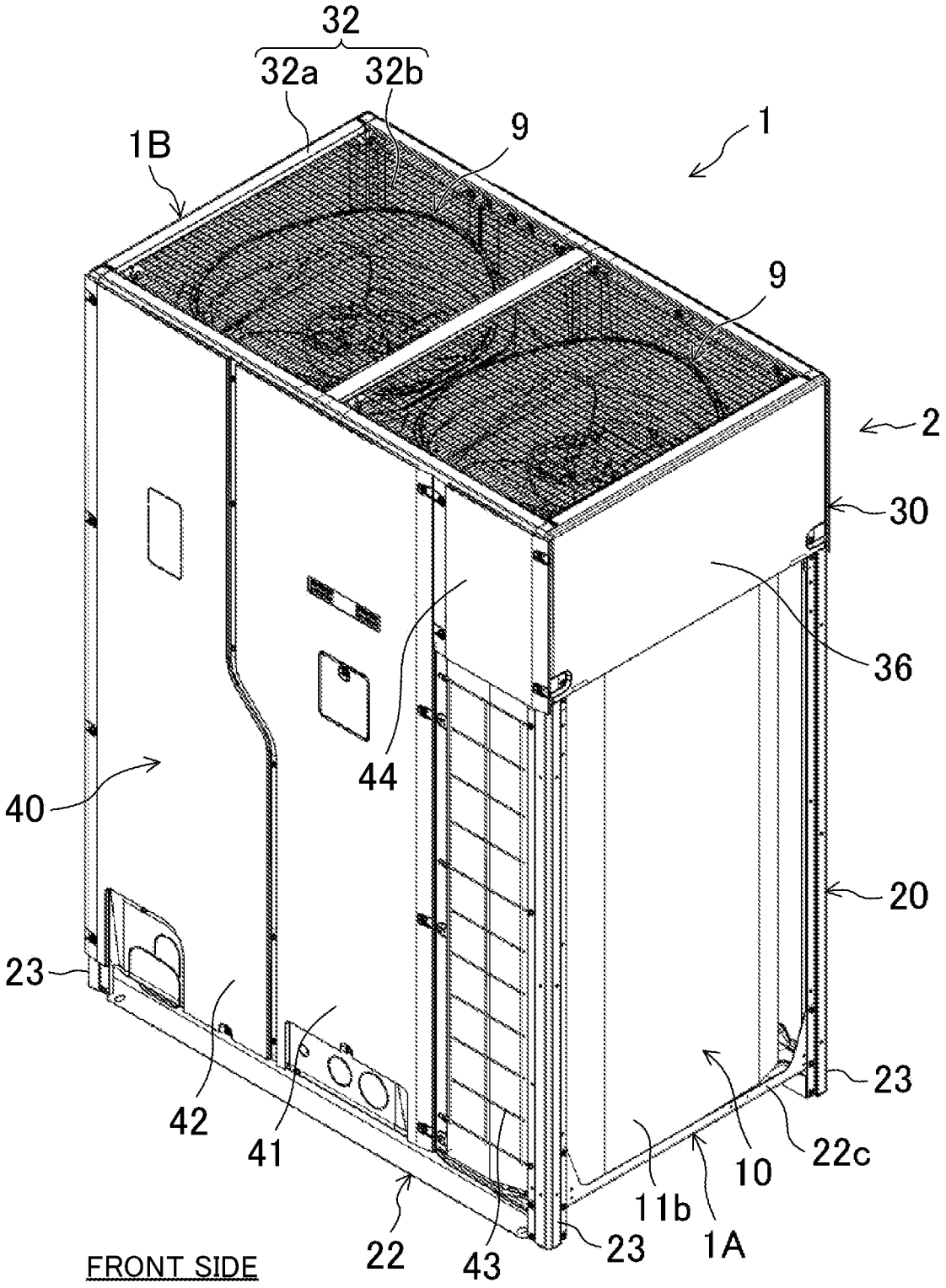
FIG. 14 is a perspective view of an outdoor unit of a second embodiment viewed from the front side.
Figure 15:
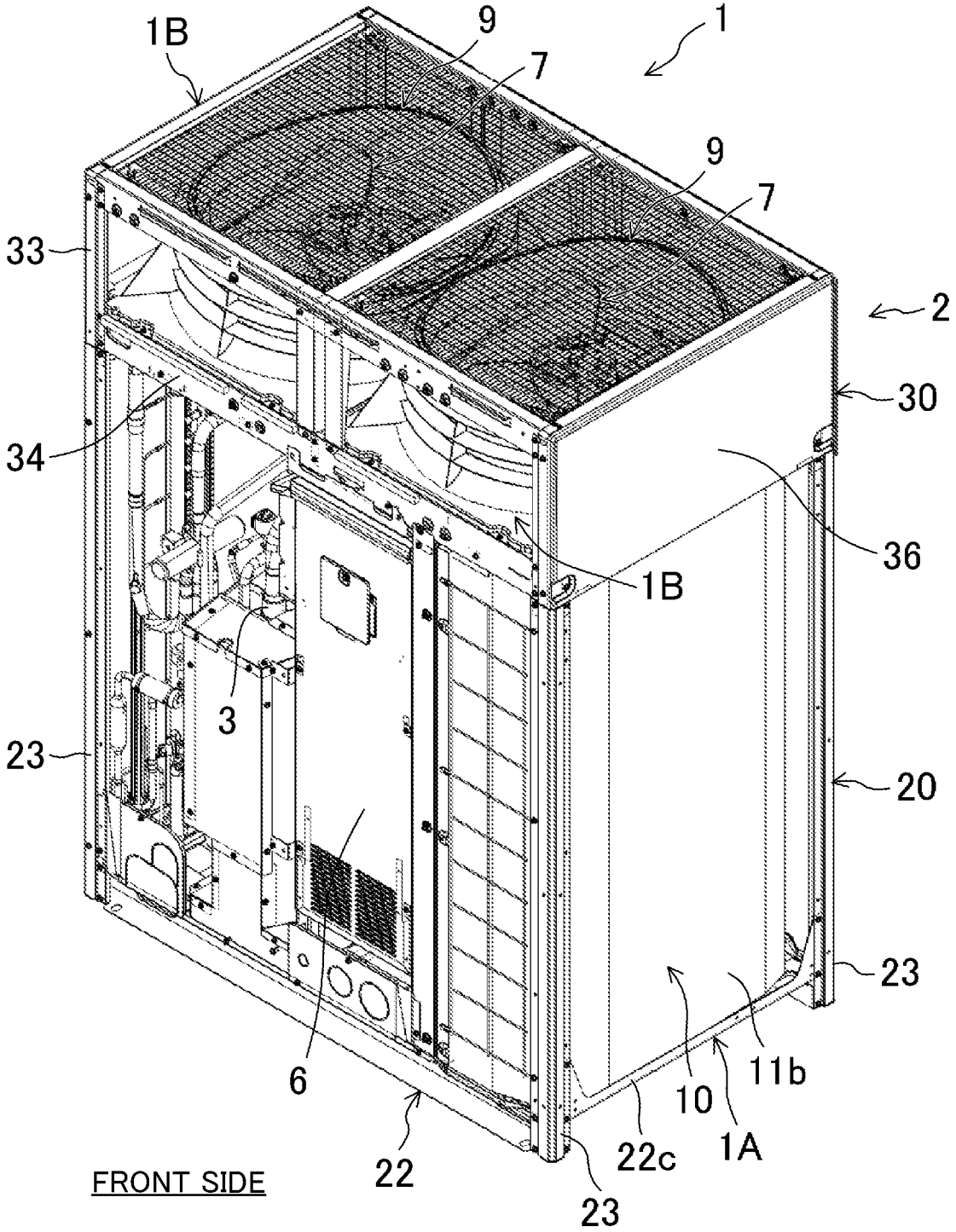
FIG. 15 is a perspective view of the outdoor unit of FIG. 14 without a front panel, viewed from the front side.
Figure 16:
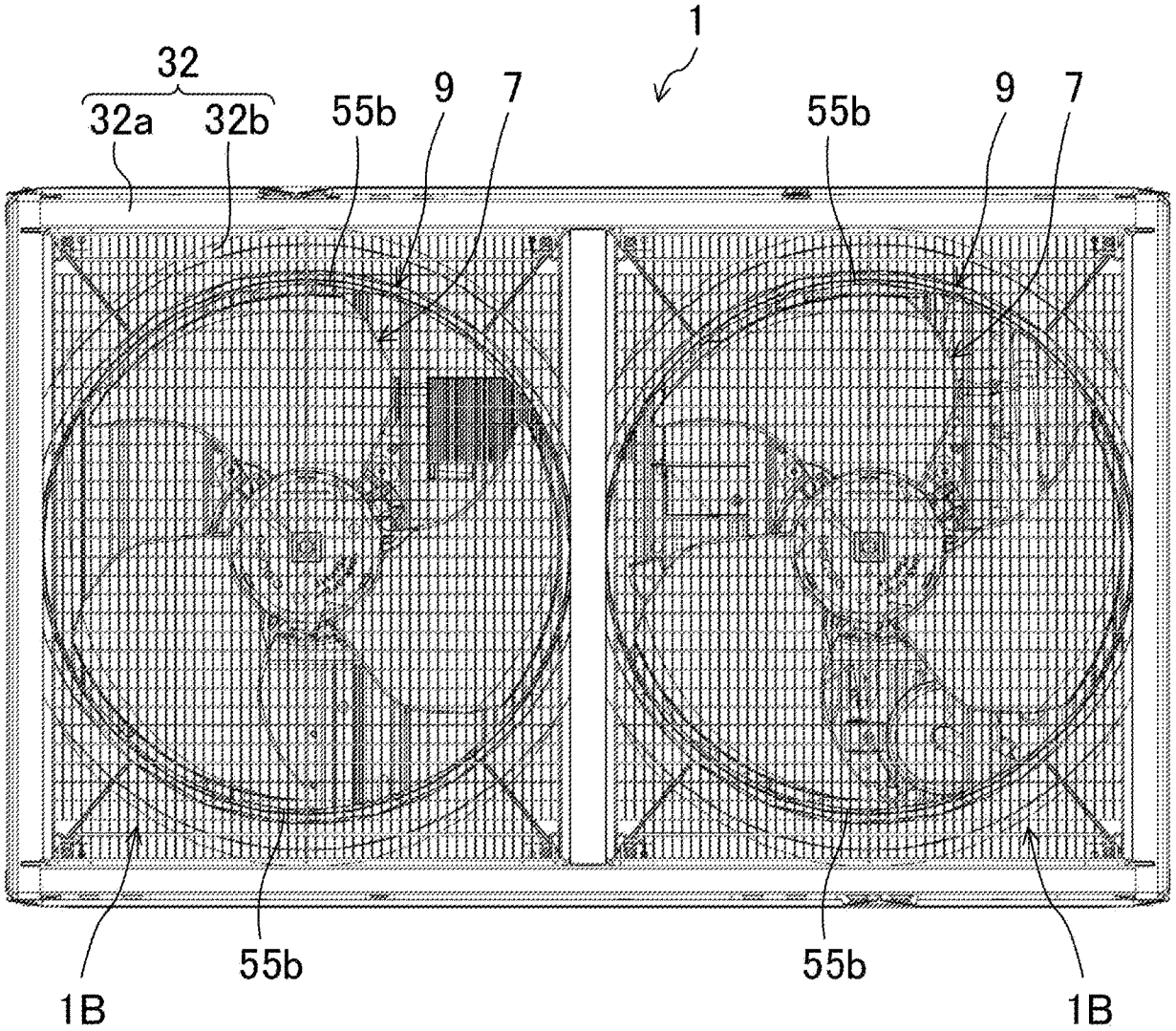
FIG. 16 is a plan view of the outdoor unit of FIG. 14.

In the embodiment, the outdoor unit (1) having one upper unit (fan unit) (1B) has been described. However, the outdoor unit (1) may include two upper units (1B) as shown in FIGS. 14 to 16. This outdoor unit (1) has a width dimension of the casing (2) wider than the width dimension of the casing (2) of the above embodiments.

Although not illustrated in detail, in this modification, the right side surface (11*b*) of the outdoor heat exchanger (10) extends so as to reach behind the front side of the lower casing (20). The lower casing (20) is provided with a suction grille (43) covering the extended portion of the outdoor heat exchanger (10). In the upper casing (30), a third front panel (44) is mounted so as to be positioned above the suction grille (43).

In the outdoor unit (1) of this modification, two sets of components each including, e.g., the fan (7), the fan motor (8), and the bell mouth (9) are arranged next to each other in the width direction of the casing (2). On the other hand, in the outdoor unit (1), two upper casings (fan casings) (30) are arranged next to each other. Each of the upper casing (30) has a cross section in a rectangular shape taken perpendicularly to the axis direction of the fan (7) and having the width and the depth different from each other. Note that the front side stay (34) shown in FIG. 15 is formed of a single member extending from one end in the width direction of the casing (2) to the other. The stay (34) is a single member, but there are substantially two fan units (1B).

In the outdoor unit (1), the two fan units (1B) are arranged such that the long sides of the fan casings (30) abut each other. That is, the two fan units (1B) are arranged such that their wide spaces between the first arc region (A1) of the bell mouth (9) and the fan casing (30) do not face each other and positioned side-by-side on the front side and the back side of the casing (2).

Other configurations of the outdoor unit (1) will not be described in detail since they are the same as those of the above embodiments.

As shown in FIG. 16, in this modification, the first arc regions (A1) of the two bell mouths (9) do not face each other, and positioned side-by-side on the front side of the casing (2) and on the back side of the casing (2) as well. Since the first arc regions (A1) of the two bell mouths (9) do not face each other, as described above, streams of air blown out from the guide portions (55*b*) provided in the first arc regions (A1) of the bell mouths (9) do not collide with each other inside the casing (2). In a configuration in which the first arc regions (A1) of the two bell mouths (9) face each other, streams of air blown out from the guide portions (55*b*) may collide with each other and linger. However, according to this modification, air is less likely to linger. Consequently, if the fan casing (30) is arranged as in the present modification, loss of the blow-out air may be effectively reduced in the configuration in which two fan units (1B) are provided.

—Second Modification—

In the above-described embodiments, the guide portions (55*b*) of the bell mouth (9) are formed in two positions of the cylindrical portion (55), and the two guide portions (55*b*) are respectively formed in the first arc regions (A1) so as to face each other. However, the arrangement of the guide portion (55*b*) may be changed. For example, two guide portions (55*b*) may be formed in each of the two first arc regions (A1), or one or a plurality of guide portions (55*b*) may be formed in one of the first arc regions (A1).

—Third Modification—

In the above embodiments, the guide portion (55*b*) of the bell mouth (9) has an inclined shape, and the extending amount of the first arc region (A1), which is the guide portion (55*b*), continuously increases from each of the both end portions of the first arc region (A1) toward the middle portion (P) thereof. However, for example, the end portion of the guide portion (55*b*) may be have a stepwise shape, and the extending amount may increase stepwise from each of the both end portions of the first arc region (A1) toward the middle portion (P) thereof. In short, the guide portion (55*b*) may be configured in any way as long as the first arc region (A1) extends further toward a downstream side than the downstream end of the second arc region in the air-blowing direction.

—Fourth Modification—

In the embodiment, the guide portion (55*b*) of the bell mouth (9) is configured such that the interior surface of the cylindrical portion (55) gradually inclines radially outward from the upstream side to the downstream side in the air-blowing direction. However, the interior surface of the guide portion (55*b*) does not necessarily have to be inclined by the angle (0).

—Fifth Modification—

In the above embodiments, the upper casing (fan casing) (30) has a rectangular shape in a plan view. However, the upper casing (fan casing) (30) may have any other shapes as long as the upper casing (fan casing) (30) has different width and depth. Further, the shape of the blow-out grille is not limited to a rectangular shape.

—Sixth Modification—

In the above embodiments, the outdoor unit (1) including a U-shaped heat exchanger (10) in a plan view was described. However, the shape and arrangement of the outdoor heat exchanger (10) may be changed. For example, in the outdoor unit (1), three plate-shaped heat exchangers may be disposed on the three side surfaces of the casing (2), or an L-shaped heat exchanger having one bent portion and a plate-shaped heat exchanger may be combined.

—Seventh Modification—

In the above embodiments, the front panel (40) is formed as a member mounted across the lower casing (20) and the upper casing (30) so as to cover a portion from the lower end of the lower casing (20) to the upper end of the upper casing (30). However, the front panel (40) may be divided into an upper panel and a lower panel, such that the upper and lower panels are attached to the upper casing (30) and the lower casing (20), respectively.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

INDUSTRIAL APPLICABILITY

As described above, the present disclosure is useful for a fan unit and an outdoor unit of an air conditioner including the fan unit.

DESCRIPTION OF REFERENCE CHARACTERS

1 Outdoor Unit
1B Fan Unit
7 Fan
9 Bell Mouth
10 Outdoor Heat Exchanger
20 Lower Casing (Main Casing)
32*b* Blow-out Grille
30 Upper Casing (Fan Casing)
55 Cylindrical Portion
55*b* Guide Portion
55*d* Extended End
A1 First Arc Region
A2 Second Arc Region

What is claimed is:

1. A fan unit comprising:
a fan casing having:
a long side corresponding to either a width or a depth of the fan casing;
a short side corresponding to the other of the width or the depth; and
an upper surface on which a blow-out grille is mounted;
a fan housed in the fan casing and that blows out air from the blow-out grille; and
a bell mouth comprising a cylindrical portion that surrounds the fan inside the fan casing, wherein
the cylindrical portion comprises:
two first arc regions each facing the short side of the fan casing;
a second arc region facing the long side of the fan casing; and
a guide portion disposed in at least one of the first arc regions, wherein
the guide portion extends farther than an end of the second arc region in an air-blowing direction,
the guide portion comprises an extended end extending from the cylindrical portion, wherein the extended end has a dimension that continuously increases from both ends of the at least one of the first arc regions toward a middle portion between the ends of the at least one of the first arc regions,
an upper edge of the middle portion is continuously curved in the air-blowing direction, and
the extended end has an upper edge continuously curved from the upper edge of the middle portion to an upper edge of each of the ends of the at least one of the first arc regions.

2. The fan unit of claim 1, wherein the cylindrical portion comprises another guide portion, wherein the two guide portions are disposed in the two first arc regions, respectively, such that the two guide portions face each other.

3. The fan unit of claim 1, wherein an interior surface of the guide portion gradually inclines radially outward from an upstream side toward a downstream side in the air-blowing direction.

4. An outdoor unit of an air conditioner, the outdoor unit comprising:
the fan unit according to claim 1; and
a main casing on which the fan unit is mounted, wherein the main casing houses a heat exchanger.

5. The outdoor unit of claim 4, further comprising:

one or more additional fan units, wherein the fan casing of each of the fan units has a rectangular cross section that is perpendicular to an axis direction of the fan and has a width and a depth different from each other, wherein among the fan units, the long side of the fan casing of a first fan unit abuts the long side of the fan casing of a second fan unit.

6. The fan unit of claim 2, wherein an interior surface of the guide portion gradually inclines radially outward from an upstream side toward a downstream side in the air-blowing direction.

7. An outdoor unit of an air conditioner, the outdoor unit comprising:

the fan unit according to claim 2; and a main casing on which the fan unit is mounted, wherein the main casing houses a heat exchanger.

8. An outdoor unit of an air conditioner, the outdoor unit comprising:

the fan unit according to claim 3; and a main casing on which the fan unit is mounted, wherein the main casing houses a heat exchanger.

9. The outdoor unit of claim 7, further comprising:

one or more additional fan units, wherein the fan casing of each of the fan units has a rectangular cross section that is perpendicular to an axis direction of the fan and has a width and a depth different from each other, wherein among the fan units, the long side of the fan casing of a first fan unit abuts the long side of the fan casing of a second fan unit.

10. The outdoor unit of claim 8, further comprising:

one or more additional fan units, wherein the fan casing of each of the fan units has a rectangular cross section that is perpendicular to an axis direction of the fan and has a width and a depth different from each other, wherein among the fan units, the long side of the fan casing of a first fan unit abuts the long side of the fan casing of a second fan unit.

* * * * *